US006165285A

United States Patent [19]

Evers et al.

[11] Patent Number: 6,165,285

[45] Date of Patent: Dec. 26, 2000

[54] METHOD FOR THE CLEANING OF DELICATE SURFACES

[75] Inventors: Marc François Theophile Evers, Strombeek-Bever, Belgium; Roberta Margherita Romano, Munich, Germany

[73] Assignee: The Procter & Gamble Company, Cincinnati, Ohio

[21] Appl. No.: 09/091,617

[22] PCT Filed: Dec. 6, 1996

[86] PCT No.: PCT/US96/19402

§ 371 Date: Oct. 21, 1998

§ 102(e) Date: Oct. 21, 1998

[87] PCT Pub. No.: WO97/22679

PCT Pub. Date: Jun. 26, 1997

[30] Foreign Application Priority Data

Dec. 18, 1995 [EP] European Pat. Off. ..... 95870133

[51] Int. Cl.[7] ..... B08B 7/00; C11D 17/00

[52] U.S. Cl. ..... 134/40; 510/214; 510/274; 510/435; 510/508; 510/509

[58] Field of Search ..... 510/181, 182, 510/490, 406, 427, 405, 459, 435, 214, 274, 508, 509; 134/40

[56] References Cited

U.S. PATENT DOCUMENTS

| | | | |
|---|---|---|---|
| 4,828,722 | 5/1989 | Steltenkamp | 252/8.8 |
| 4,877,459 | 10/1989 | Cockrell, Jr. et al. | 134/40 |
| 5,108,643 | 4/1992 | Loth et al. | 252/174.11 |
| 5,254,290 | 10/1993 | Blandiaux et al. | 252/545 |
| 5,298,180 | 3/1994 | Dixit | 252/94 |
| 5,346,641 | 9/1994 | Argo et al. | 252/163 |
| 5,378,409 | 1/1995 | Ofosu-Asante | 252/548 |
| 5,393,468 | 2/1995 | Erilli et al. | 252/550 |
| 5,437,807 | 8/1995 | Garabedian, Jr. et al. | 252/153 |
| 5,552,089 | 9/1996 | Misselyn et al. | 510/417 |
| 5,707,948 | 1/1998 | Evers et al. | 510/217 |

FOREIGN PATENT DOCUMENTS

| | | | |
|---|---|---|---|
| 1032360 | 4/1989 | China | B08B 3/08 |
| 1055198 | 10/1991 | China | C11D 7/60 |
| WO 96/41856 | 12/1996 | WIPO . | |

*Primary Examiner*—Necholus Ogden
*Attorney, Agent, or Firm*—Jason J. Camp

[57] ABSTRACT

Compositions are disclosed which are suitable for the safe cleaning of delicate surfaces, i.e. marble and lacquered surfaces, e.g. lacquered wooden floors. The compositions disclosed herein comprise at least one anionic surfactant, they are free of strong builders, they are formulated in the mildly acidic to mildly alkaline pH range, and they comprise positive divalent ions in amounts so as to saturate the anionic surfactant in the composition.

7 Claims, No Drawings

METHOD FOR THE CLEANING OF DELICATE SURFACES

TECHNICAL FIELD

The present invention relates to hard surface cleaning compositions. The compositions herein are specifically designed for the safe cleaning of marble, painted and lacquered surfaces, especially lacquered and painted wood.

BACKGROUND

A wide variety of cleaning compositions for hard surfaces have been disclosed in the prior art. Most of these compositions are concerned only with performance, on a wide variety of stains and in a wide variety of conditions. And most hard surfaces are rather resistant to the point that it is generally not a concern that these surfaces may be permanently damaged by the cleaning composition.

However marble and lacquered surfaces are two types of surfaces which do require particular attention, when formulating cleaning compositions for their cleaning. Indeed, marble is mainly composed of calcium carbonate, and is therefore incompatible with cleaning compositions which would be acidic, and/or which would comprise a builder. Indeed, acidity would "dissolve" marble, while the builder, whose function is specifically to bind ions which are present in water and dirt particles, would also bind the calcium in the marble, thereby turning the surface from very shiny to dull, as the introduced surface irregularities lower the reflectance of the surface. We have also found that cleaning products formulated at neutral pH and which contain anionics surfactants also damage marble, probably because the anionic surfactants would also bind the calcium in the marble as described hereinabove. Thus the formulation of an alkaline composition free of anionic surfactants would seem indicated in the present circumstances.

However, the formulation of an alkaline composition does not accommodate the cleaning of lacquered and painted surfaces, such as painted metal surfaces, or lacquered and painted wooden surfaces e.g. lacquered wooden floors. As used herein, lacquers are typically made out of polyurethanes or polyacrylates or mixtures of both, and paint is mainly pigmented polyacrylates, polyvinylacetates or alkydresins. Indeed such surfaces are permanently damaged by alkalinity. Specifically, alkalinity would destroy the lacquer and therefore give the lacquered surface the appearance of dullness or a colour change. Thus it would appear that formulating a cleaning composition which is suitable for cleaning both marble and lacquered surfaces is hindered by incompatible pH requirements.

Also, the absence of an anionic surfactant, which is desirable for preserving the marble, is somewhat incompatible with a good overall cleaning performance, specifically soil solubilization/grease emulsification.

Thus it is an object of the present invention to formulate a liquid composition which is suitable, i.e. safe, for the cleaning of both marble and lacquered surfaces, and which comprises an anionic surfactant so as to provide good cleaning performance, in particular which performs well on grease removal.

In response to this object, we have formulated a liquid composition which comprises at least one anionic surfactant, which is free of strong builders, which is formulated at a mildly acidic to mildly alkaline pH, and which comprises positive divalent ions in amounts so as to saturate the anionic surfactant in the composition.

Indeed, we have found that in the present compositions, the mildly acidic to mildly alkaline pH damages neither marble nor lacquers. Also, the positive divalent ions in a saturating amount for the anionic surfactant prevents the damage on marble, while still allowing the anionic surfactant to perform its cleaning action.

Cleaning composition which are said to be for delicate surfaces are described in EP 511 091, CN 1055198 (title) and CN 10 32 360 (title).

SUMMARY OF THE INVENTION

The present invention encompasses a liquid cleaning composition which comprises at least one anionic surfactant, which is free of strong builders, which is formulated at a mildly acidic to mildly alkaline pH, and which comprises positive divalent ions in an amount so as to saturate the anionic surfactant in the composition.

The present invention further encompasses a method of cleaning marble or lacquered surfaces, where an effective amount of said composition is applied to clean said marble or lacquered surfaces, and said composition is removed.

DETAILED DESCRIPTION OF THE INVENTION

The compositions herein are liquid compositions. They are typically aqueous and typically comprise from 10% to 99% by weight of the total composition, preferably from 15% to 95%, most preferably from 30% to 92% of water.

The anionic surfactant

As a first essential characteristic, the compositions herein comprise at least one anionic surfactant, required for cleaning. Suitable anionic surfactants for use herein include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described hereinbelow), and alkyl polyethoxy carboxylates such as those of the formula $RO(CH_2CH_2O)_k$—$CH_2COO^{31}M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwart, Perry and Berch). Also suitable anionic surfactants for use herein include alkyl ester sulfonate surfactants, i.e. linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty acid substances as derived from tallow, palm oil, etc.

Also suitable as anionic surfactants for use herein are alkyl sulfate surfactants hereof, which are water soluble salts or acids of the formula $ROSO_3M$ wherein R preferably is a $C_{10}$–$C_{24}$ linear or branched hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like).

Still further suitable anionic surfactants for use herein are alkyl alkoxylated sulfate surfactants herein, which are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium cations and quaternary ammonium cations such as tetramethyl-ammonium and dimethyl piperdinium cations and those derived from alkylamines such as ethylamine, diethylamine, triethylamine, mixtures thereof, and the like. A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

The compositions of the present invention comprise from 0.1% to 30% by weight of the total composition of said anionic surfactant or mixtures thereof, preferably from 0.5% to 15%, most preferably 0.5% to 5%.

The optional co-surfactant

The compositions herein may comprise additional, non anionic surfactants. Suitable such co-surfactants include nonionic, cationic and amphoteric surfactants.

Cationic detersive surfactants suitable for use in compositions of the present invention are those having a long-chain hydrocarbyl group. Examples of such cationic surfactants include the ammonium surfactants such as alkyldimethylammonium halogenides, and those surfactants having the formula $$[R^2(OR^3)_y][R^4(OR^3)_y]_2R^5N^+X^{31}$$

wherein $R^2$ is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2CHOH—CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

Ampholytic surfactants are also suitable for use in the compositions of the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

Zwitterionic surfactants are also suitable for use in the present compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 (herein incorporated by reference) for examples of zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)_xN(R^5)_2 \rightarrow O$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Preferred co-surfactants for use herein are nonionic surfactants. Suitable nonionic surfactants herein comprise polyethylene, polypropylene, and polybutylene oxide condensates of alkyl phenols, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 5 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton$^{MT}$ X-45, X-114, X-100 and X-102, all marketed by Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are also suitable for use herein. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 10 to about 18 carbon atoms, with from about 2 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.5 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), marketed by Shell Chemical Company, and Kyro™ EOB.

Also useful as an additional nonionic surfactant are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose, and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions of the preceding saccharide units.

Optionally, and less desirably, there can be a polyalkkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glucosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6- position, preferably predominantely the 2- position.

Although not preferred, the condensation products of ethylene oxide with a hydrophobic base formed by the condensation of propylene oxide with propylene glycol are also suitable for use herein. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic™ surfactants, marketed by BASF.

Also not preferred, although suitable for use as nonionic surfactants herein are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5000 to about 11000. Examples of this type of nonionic surfactant include certain of the commercially available Tetronic™ compounds, marketed by BASF.

Other suitable nonionic surfactants for use hrein include polyhydroxy fatty acid amides of the structural formula:

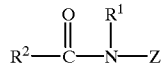

(I)

wherein : $R^1$ is H, $C_1$–$C_4$ hydrocarbyl, 2-hydroxy ethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugards include glucose, fructose, maltose, lactose, galactose, mannose, and xylose. As raw materials, high dextrose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocarnide, stearamide, oleamide, lauramide, myristamide, capricamide, palmitarnide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Preferred for use as nonionic surfactants herein are polyethylene oxide condensates of alkyl phenols, condensation products of primary and secondary aliphatic alcohols with from about 1 to about 25 moles of ethyelene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferaby $C_{10}$ avg.) having from 2 to 10 ethoxy groups, and mixtures thereof. Preferred co-surfactants for use herein are nonionic surfactants for their cleaning action on grease.

The compositions herein may comprise from 0.2% to 90% by weight of the total composition of said co-surfactants or mixtures thereof, preferably from 1% to 50%, most preferably from 2% to 20%.

The positive divalent ions

As a second essential ingredient, the compositions herein comprise positive divalent ions in amounts so as to saturate the anionic surfactant present in the composition. By "saturate", it is meant herein that there should be enough positive divalent ions to bind substantially all the anionic surfactant—i.e. the negative charges of the anionic surfactant—present in the composition, i.e. at least 75% of the anionic surfactant, preferably at least 80%, most preferably at least 90% or all of anionic surfactant. Different species of anionic surfactants have different number of anions per mole of surfactant. Thus, for a 100% saturation, if X is the number of negative charges per mole of anionic present in the composition, the compositions herein will comprise positive divalent ions in a molar ratio of positive divalent ions to anionic surfactant of at least X:2. And for the purpose of the present invention and the amount of positive divalent ions needed therein, the form—protonated or not—in which the anions of the anionic surfactant are present is not critical.

Suitable positive divalent ions for use herein include $Mg^{2+}$, $Ba^{2+}$, $Fe^{2+}$, $Ca^{2+}$, $Zn^{2+}$ and $Ni^{2+}$. Most Preferred are $Mg^{2+}$ and $Ca^{2+}$, or mixtures thereof. The ions can be introduced in the compositions in any form. As far as Mg is concerned, $MgCl_2$ has been found to be commercially attractive. However $MgSO_4$ and $MgNO_3$ are also suitable source of Mg ions for the compositions herein. Without wishing to be bound by theory, we speculate that the ions herein somehow prevent the builder from binding with the calcium in the marble, without preventing the builder from performing in the cleaning operation. In another embodiment, salts of the anionic surfactants and the divalent positive ions can be pre-formed, before they are introduced in the composition The pH As a third essential characteristic, the compositions herein are formulated at a mildly acidic to mildly alkaline pH. Accordingly, the compositions herein preferably have a pH between 6 and 9, more preferably between 6.5 and 8, and most preferably between 6.5 and 7.5. At lower pH, the composition would damage marble while, at higher pH, it would damage lacquers. Interestingly, even in neutral pH in which the compositions herein can be formulated, damage to marble would be observed in the abscence of the saturating ions. The pH of the compositions herein can be adjusted by any of the means well known to the man skilled in the art, such as addition of NaOH, KOH, MEA,TEA,MDEA, K2CO3,$Na_2CO_3$ and the like, or sulphuric acid, nitric acid, hydrochloric acid, acetic acid and the like.

Free of strong builders

It is essential that the compositions herein be free of strong builders. By strong builders, it is meant herein polycarboxylates and polyphosphates described hereinbelow:

Strong polycarboxylates builders excluded herein are organic polycarboxylates where the highest LogKa, measured at 25° C./0.1M ionic strength is between 3 and 8, wherein the sum of the LogKCa+LogKMg, measured at 25° C./0.1M ionic strength is higher than 4, and wherein LogKCa=LogKMg±2 units, measured at 25° C./0.1M ionic strength.

Such polycarboxylates include citrate and complexes of the formula:

$$CH(A)(COOX)—CH(COOX)—O—CH(COOX)—CH(COOX)(B)$$

wherein A is H or OH; B is H or $—O—CH(COOX)—CH_2(COOX)$; and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is $—O—CH(COOX)—CH_2(COOX)$, then the compound is tartrate disuccinic acid (TDS) and its water-soluble salts. Mixtures of these builders are especially preferred for use herein. Particularly TMS to TDS, these builders are disclosed in U.S. Pat. No. 4,663,071, issued to Bush et al., on May 5, 1987.

Still other ether polycarboxylates excluded herein include copolymers of maleic anhydride with ethylene or vinyl methyl ether, 1, 3, 5-trihydroxy benzene-2, 4, 6-trisulfonic acid, and carboxymethyloxysuccinic acid.

Other polycarboxylate builders excluded herein are the ether hydroxypolycarboxylates represented by the structure:

$$H0—[C(R)(COOM)—C(R)(COOM)—O]_n—H$$

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl.

Excluded ether polycarboxylates are also cyclic compounds, particularly alicyclic compounds, such as those described in U.S. Pat. Nos. 3,923,679; 3,835,163; 4,158,635; 4,120,874 and 4,102,903, all of which are incorporated herein by reference, particularly dipicolinic acid and chelidanic acid.

Also excluded polycarboxylates herein are mellitic acid, succinic acid, polymaleic acid, benzene 1,3,5-tricarboxylic acid, benezene pentacarboxylic acid, and carboxymethyloxysuccinic acid, and soluble salts thereof.

Still excluded carboxylate builders herein are the carboxylated carbohydrates disclosed in U.S. Pat. No. 3,723,322, Diehl, issued Mar. 28, 1973, incorporated herein by reference.

Other excluded carboxylates herein are alkali metal, ammonium and substituted ammonium salts of polyacetic acids. Examples of polyacetic acid builder salts are sodium, potassium, lithium, ammonium and substituted ammonium salts of ethylenediamine, tetraacetic acid and nitrilotriacetic acid.

Other excluded polycarboxylates herein are those also known as alkyliminoacetic builders such as methyl imino diacetic acid, alanine diacetic acid, methyl glycine diacetic acid, hydroxy propylene imino diacetic acid and other alkyl imino acetic acid builders.

Also excluded from the compositions of the present invention are the 3,3-dicarboxy-4-oxa-1,6-hexanediotes and the related compounds disclosed in U.S. Pat. No. 4,566,984, Bush, issued Jan. 28, 1986, incorporated herein by reference. Succinic acid builders include the C5–C20 alkyl succinic acids and salts thereof, particularly dodecenylsuccinic acid. Alkyl succinic acids excluded herein typically are of the general formula R—CH(COOH)$CH_2$(COOH) i.e., derivatives of succinic acid, wherein R is hydrocarbon, e.g., $C_{10}$–$C_{20}$ alkyl or alkenyl, or wherein R may be substituted with hydroxyl, sulfo, sulfoxy or sulfone substituents, all as described in the above-mentioned patents.

Specific examples of succinate builders excluded herein are laurylsuccinate, myristylsuccinate, palmitylsuccinate, 2-dodecenylsuccinate, 2-pentadecenylsuccinate, and the like.

Other examples of excluded builders are sodium and potassium carboxymethyloxymalonate, carboxymethyloxysuccinate, cis-cyclohexanehexacarboxylate, cis-cyclopentane-tetracarboxylate, water-soluble polyacrylates and the copolymers of maleic anhydride with vinyl methyl ether or ethylene.

Other excluded polycarboxylates are the polyacetal carboxylates disclosed in U.S. Pat. No. 4,144,226, Crutchfield et al., issued Mar. 13, 1979, incorporated herein by reference.

Excluded polycarboxylate builders are also disclosed in U.S. Pat. No. 3,308,067, Diehl, issued Mar. 7, 1967, incorporated herein by reference. Such materials are the water-soluble salts of homo- and copolymers of aliphatic carboxylic acids such as maleic acid, itaconic acid, mesaconic acid, fumaric acid, aconitic acid, citraconic acid and methylenemalonic acid.

Excluded polyphosphonates herein are the alkali metal, ammonium and alkanolammonium salts of polyphosphates (exemplified by the tripolyphosphates, pyrophosphates, and glassy polymeric meta-phosphates), phosphonates.

The compositions herein can further comprise a variety of well known optional ingredients, including perfumes, and dyes. However, the compositions herein are free of builders and they should be substantially free of solvents which would otherwise damage lacquers.

Particularly preferred compositions herein comprise an effective amount of a carbonate of the formula $XHCO_3$, where X is an alkali metal, particularly $K^+$, $Na^+$, or $NH_4^+$. Indeed, apart from the pH adjusting effect just described, we have found that the presence of those compounds furher improves the safety of the compositions herein to delicate surfaces. Without wishing to be bound by theory, it is believed that the compounds react with the calcium on the surface of marble, to form an insoluble calcium carbonate salt at the marble/solution interface, creating a protective layer. Using these compounds in addition to the saturation technology described hereinabove provides a synergetic effect on delicate surface safety. The amount of these compounds needed in the compositions herein can be determined by trial and error, but appears to lie in the range of from 0.05% to 0.4% by weight of the total composition, preferably from 0.05% to 0.1%. Caution needs to be exercised however in that we have observed that too high an amount of $XHCO_3$ may raise be dertimental to surface safety on lacquered wood.

The present invention further encompasses a method of cleaning marble or lacquered surfaces. In that method, an effective amount of a composition as herein before described is applied onto said marble or lacquered surface, and said composition is optionally removed.

Depending on the surface which is being cleaned, the compositions herein can be used undiluted, i.e. neat, or diluted. Typically, when used on large surfaces, such as floors, the compositions herein are used in diluted form, i.e. at dilution levels of from about 0.5% to 1.5%, depending on how concentrated the product is. In such diluted conditions, the compositions herein are applied to said surface, and left to dry, i.e. no rinsing is required. In order to remove tough stains on these surfaces the product can also be applied neat on the surface to remove the encrustated dirt much more easily. When used on smaller surfaces, e.g. bathroom walls which can be made out of marble, neat usage of the composition will be preferred. In neat usage, it is preferable that the composition should be removed, i.e. rinsed off after it has been applied to clean.

The present invention will be further illustrated by the following examples.

EXAMPLES

The following compositions were made by mixing the listed ingredients in the listed proportions. These compositions were used neat to clean marble and dilute to clean lacquered wooden floors. Excellent cleaning and surface safety performance was observed.

| Ingredients | Compositions (weight %) | | | | | |
|---|---|---|---|---|---|---|
| Example N | 1 | 2 | 3 | 4 | 5 | 6 |
| NaPS | 1.0 | 3.0 | — | — | 4.0 | 3.0 |
| NaLAS | — | — | 2.0 | — | — | — |
| $NaAE_2S$ | — | — | — | 2.0 | — | — |
| R-$AE_x$ | 6.0 | 4.0 | 5.0 | 6.0 | 4.0 | 4.0 |
| Mg | 0.08 | 0.20 | 0.13 | 0.12 | — | — |
| $NaHCO_3$ | — | 0.10 | 0.11 | 0.10 | — | — |
| Na2HPO4 | — | — | — | — | 0.2 | — |
| Na2H3P3O10 | — | — | — | — | — | 0.15 |
| pH | 7.1 | 7.5 | 7 | 7.3 | 7.4 | 7.5 |
| water and minors | | | up to 100% | | | |

What is claimed is:

1. A method of cleaning marble or lacquered surfaces with an aqueous composition having a pH of 6 to 9, said composition comprising:

(a) 0.1% to 30% of anionic surfactant, and (b) positive divalent ions selected from the group consisting of $Mg_2^+$, $Ca_2^{30}$ and mixtures thereof in an amount 0.05% to 4% by weight whereby the molar ratio of said ions to negative charges per mole of anionic surfactant is at least 2;

(c) from about 0.05% to about 0.4% by weight of a carbonate of the formula $XHCO_3$ where X is an alkali metal or ammonium ion;

wherein said composition is free of polyphosphate builders and strong organic polycarboxylate builders, said strong polycarboxylate builders being those wherein the highest LogKa, measured at 25° C./0.1M ionic strength is between 3 and 8, wherein the sum of LogKCa+LogKMg measured at 25° C./0.1M ionic strength is greater than 4 and wherein LogCa equals LogMg±2 units, measured at 25° C./0.1M ionic strength, said method comprising the step of applying the said composition to said marble or lacquered surface and thereafter optionally removing said composition from said surface.

2. A method according to claim 1 wherein said composition is formulated in a pH range of from about 6.5 to about 8.

3. A method according to claim 2 wherein said composition is formulated in a pH range of from about 6.5 to about 7.5.

4. A method according to claim 1 wherein said composition comprises from about 0.1% to about 20% by weight of the total composition of said anionic surfactant.

5. A method according to claim 4 wherein said composition comprises from about 0.1% to about 10% by weight of the total composition of said anionic surfactant.

6. A method according to claim 1 wherein said composition further includes a nonionic co-surfactant.

7. A method according to any of claims 6 or 1 wherein said composition is applied in diluted form at a concentration of 0.5 to 1.5%.

* * * * *